US011873463B2

(12) United States Patent
Driedger et al.

(10) Patent No.: US 11,873,463 B2
(45) Date of Patent: Jan. 16, 2024

(54) METHOD AND SYSTEM FOR RE-REFINING AND UPGRADING USED OIL

(71) Applicant: ReGen III Corp., Vancouver (CA)

(72) Inventors: Gordon Driedger, Vancouver (CA); Zachary Moore, Calgary (CA)

(73) Assignee: ReGen III Corp., Vancouver (CA)

( * ) Notice: Subject to any disclaimer, the term of this patent is extended or adjusted under 35 U.S.C. 154(b) by 281 days.

(21) Appl. No.: 17/426,223

(22) PCT Filed: Feb. 5, 2020

(86) PCT No.: PCT/CA2020/050145
§ 371 (c)(1),
(2) Date: Jul. 28, 2021

(87) PCT Pub. No.: WO2020/160662
PCT Pub. Date: May 13, 2020

(65) Prior Publication Data

US 2022/0089968 A1 Mar. 24, 2022

(30) Foreign Application Priority Data

Feb. 5, 2019 (EP) ..... 19155542

(51) Int. Cl.
*C10M 175/00* (2006.01)
*C10G 67/04* (2006.01)
(Continued)

(52) U.S. Cl.
CPC ..... *C10M 175/005* (2013.01); *C10G 67/0436* (2013.01); *C10G 67/14* (2013.01);
(Continued)

(58) Field of Classification Search
CPC ..... C10M 175/005; C10M 175/0033; C10M 175/0041; C10M 175/02; C10G 67/0436;
(Continued)

(56) References Cited

U.S. PATENT DOCUMENTS 3,565,921 A 2/1971 Gobron et al.
4,797,198 A 1/1989 Wetzel et al.
(Continued)

FOREIGN PATENT DOCUMENTS

CN 107699280 2/2018
CN 106929100 9/2018
(Continued)

OTHER PUBLICATIONS

Database WPI, Week 201818, Thomson Scientific, London, GB; AN 2018-15426W; XP002793603, & CN 107 699 280 A (Qingdao Inst Bioenergy & Bioprocess Tech); Feb. 16, 2018 (1 page).
(Continued)

*Primary Examiner* — Randy Boyer
*Assistant Examiner* — Juan C Valencia
(74) *Attorney, Agent, or Firm* — Klarquist Sparkman, LLP

(57) ABSTRACT

A method for re-refining used oils comprises contacting feedstock comprising purified used oil with extraction solvent to perform continuous liquid-liquid solvent extraction, to produce an extract stream comprising the extraction solvent and an extract dissolved in the extraction solvent. The feedstock and the extraction solvent are agitated by a variable speed agitator during the solvent extraction at a selected agitation speed. The extract is separated from the extraction solvent and subjected to a continuous flow liquid phase hydrogenation treatment to produce an oil product. A system for performing the method includes a purification unit for purifying the used oil; an extraction column for extracting the extract from the feedstock; and a continuous flow liquid phase hydrogenation unit. The extraction column comprises an agitator configured to agitate the feedstock and the extraction solvent flowing through the extraction column at a variable agitation speed.

18 Claims, 3 Drawing Sheets

(51) Int. Cl.
*C10G 67/14* (2006.01)
*C10M 175/02* (2006.01)

(52) U.S. Cl.
CPC ..... *C10M 175/0033* (2013.01); *C10M 175/0041* (2013.01); *C10M 175/02* (2013.01); *C10G 2300/1007* (2013.01); *C10G 2300/202* (2013.01); *C10G 2300/302* (2013.01); *C10G 2300/802* (2013.01); *C10G 2400/10* (2013.01)

(58) Field of Classification Search
CPC ..... C10G 67/14; C10G 2300/1007; C10G 2300/202; C10G 2300/302; C10G 2300/802; C10G 2400/10
See application file for complete search history.

(56) References Cited

U.S. PATENT DOCUMENTS

| | | | | |
|---|---|---|---|---|
| 9,512,369 | B1 * | 12/2016 | Noble | C10G 21/02 |
| 9,862,894 | B1 * | 1/2018 | Murray | C10G 67/04 |
| 2013/0313161 | A1 * | 11/2013 | Dindi | C10G 65/02 208/89 |
| 2014/0251869 | A1 | 9/2014 | MacDonald | |
| 2015/0375139 | A1 | 12/2015 | Wieland et al. | |
| 2019/0119605 | A1 | 4/2019 | Chung et al. | |

FOREIGN PATENT DOCUMENTS

| | | | | |
|---|---|---|---|---|
| EP | 0055492 | | 7/1982 | |
| FR | 2301592 | | 9/1976 | |
| WO | WO 2006/096396 | | 9/2006 | |
| WO | WO-2006096396 | A2 * | 9/2006 | B01D 3/065 |

OTHER PUBLICATIONS

International Preliminary Report on Patentability dated Aug. 10, 2021 from International Application No. PCT/CA2020/050145 (5 pages).
International Search Report dated Apr. 15, 2020 from International Application No. PCT/CA2020/050145 (3 pages).
Supplementary European Search Report dated Oct. 26, 2022 from European Application No. EP 20751968.7 (10 pages).
Written Opinion of the International Searching Authority dated Apr. 15, 2020 from International Application No. PCT/CA2020/050145 (4 pages).
Examination Report, dated May 9, 2023, in related Egyptian Patent Application No. 2021081198 (w/attached English Translation).

* cited by examiner

METHOD AND SYSTEM FOR RE-REFINING AND UPGRADING USED OIL

CROSS-REFERENCE TO RELATED APPLICATIONS

This application is the U.S. National Stage of International Application No. PCT/CA2020/050145, filed on Feb. 5, 2020, which in turn claims the benefit of, and priority from, European Patent Application No. 19155542.4, filed Feb. 5, 2019 and entitled "Method for Producing High Quality Base Oil from Waste Oil", the entire contents of which are incorporated herein by reference.

FIELD

The present disclosure relates generally to processes of re-refining or upgrading used oils.

BACKGROUND

Used oils, including waste oils, may be re-refined or upgraded to produce useful base oils, fuel oils, and other oil products or by-products. Base oil is also referred to as base stock, base lube stock, lube stock, lube oil, lubrication oil, or the like. Base oil can be used to produce products with lubrication properties, such as lubricating oil or metal working fluids or hydraulic fluids.

Base oils can be produced by refining crude oils, such as paraffinic crude oil or naphthenic crude oil, using different processing techniques and facilities. For example, crude oils may be subjected to heating and distillation processes to separate light and heavy hydrocarbons, and the heavy hydrocarbons are further subjected to hydrogenation to remove sulfur and aromatics thus producing base oils with higher proportions of saturates, lower sulfur contents, and higher viscosity. The light hydrocarbons produced in these processes may be used as fuel oils.

Base oils produced by refining crude oils are officially classified into different groups by the American Petroleum Institute (API). According to the current API classification (API 1509), Groups I, II and III are classified based on their physical and compositional properties. Specifically, Groups I, II and III are principally characterized and distinguished by their saturate levels, sulfur levels, and viscosity index (VI). The saturate and sulfur levels can be indicated by the percentages of saturates and sulfur in the oil. The viscosity index is a measure of the change of viscosity with temperature, typically measured at 100° F. (40° C.) and 210° F. (100° C.). Base oils with higher saturate levels, lower sulfur levels, and higher viscosity index are considered higher quality base oils. For example, according to the current API classification (API 1509), Group I base oil has less than 90% saturates and/or more than 0.03% sulfur, and a VI of at least 80 but less than 120; Group II base oil has at least 90% saturates and at most 0.03% sulfur, but the VI is still at least 80 and less than 120; Group III base oil has at least 90% saturates and at most 0.03% sulfur, and a VI of at least 120. All percentages herein are mass percent (denoted as wt %) based on the total mass of the oil product including any impurities and additives, unless otherwise specified.

Group II and Group III base oils may be considered as high quality base oils, and base oils that do not meet any of the Group I, Group II, and Group III standards are considered to be low quality base oils.

In conventional refinery processing, typically, Group I base oil may be produced after a solvent refining process.

Group II base oil may be produced after mild hydroprocessing or hydrocracking. Group III base oil may be produced by more extensive hydrocracking or catalytic de-waxing.

Used oils, such as used motor oils (UMO), can also be re-refined to produce higher quality base oils, such as Group I, II, or III base oils. For example, systems and methods for producing Group II or III base oils and other products from used oils have been proposed, where the used oil is subjected to distillation, solvent exchange in a packed extraction column, and gas phase hydrogenation treatments. See e.g., WO 2006/096396, published 14 Sep. 2006; and U.S. Pat. No. 8,366,912 issued on 5 Feb. 2013. Used oil re-refining techniques are also disclosed in U.S. Pat. No. 6,117,309 issued on Sep. 12, 2000.

However, it is still desirable to improve the conventional systems and methods for producing higher quality oils from used motor oils or other used oils.

SUMMARY

It has been recognized by the present inventor(s) that previously disclosed systems and methods for re-refining used motor oils to produce higher quality base oils and other products can be improved to be more robust and more convenient to operate to accommodate different types of input feed stocks, or to be more efficient.

For example, used oils from different sources can have different contents and constituents and properties. In particular, used oils are collected by a large number of regional waste oil gatherers who collect them from their local sites of utilization or production. In the collection process, a variety of oils, which were formulated for numerous types of service, may be mixed together to form a composite of different types and qualities of base oils, chemicals, and contaminants. Thus, providing systems and processes that could be conveniently adjusted during operation to effectively and efficiently process different feedstock oils with very different components and properties would be desirable. It is also desirable to improve the yield of recovered useful products, particularly high quality base oils such as Group III base oils, from used oils. It is further desirable to improve the throughput of such processes.

Due to the nature of used oils collected as discussed elsewhere herein, it is difficult in known processes of re-refining waste oils to achieve both high yield and high quality products. Because the feedstock could include a wide variety of oil types, qualities, and contaminants, the existing processes were typically designed to trade-off between quality and quantity, as it would be difficult to achieve both in these processes. Further, when a new type of feedstock is to be used, the existing system or process would have to be reconfigured or operated using new operation parameters to optimize the process. Such optimization would require extensive experience, testing and stringent adherence to the optimized operation parameters. Deviation from the optimized operation process or parameters could lead to one or more of reduced quality of product, system failure, reduced run time, reduced production efficiency or production yield, or increased operation costs. For example, a catalyst used in the process may have a reduced lifetime if the processing is not optimized for the particular application or deviated from the optimized operation parameters.

Accordingly, an aspect of the present disclosure relates to a method comprising contacting a feedstock comprising purified used oil with an extraction solvent to perform continuous liquid-liquid solvent extraction, to produce an extract stream comprising the extraction solvent and an extract dissolved in the extraction solvent, wherein the feedstock and the extraction solvent are agitated by a variable speed agitator during the solvent extraction at a selected agitation speed; separating the extract from the extraction solvent; and subjecting the extract to a continuous flow liquid phase hydrogenation treatment to produce an oil product having a viscosity index of at least 80.

In the method of the preceding paragraph, the liquid phase hydrogenation treatment may comprise adding a diluent to the extract to increase solubility of hydrogen in the extract, thus forming a liquid mixture comprising the diluent and the extract; adding hydrogen to the liquid mixture to dissolve the hydrogen in the liquid mixture; and heating the liquid mixture with dissolved hydrogen in the presence of a hydrogenation catalyst to saturate unsaturates in the liquid mixture, and removing sulfur and aromatics from the liquid mixture, thus forming the oil product. The extract may comprise phosphorus and silicon, and the continuous flow liquid phase hydrogenation treatment may comprise removing phosphorus and silicon from the liquid mixture before exposing the liquid mixture to the hydrogenation catalyst. The extract may comprise aromatics, and the continuous flow liquid phase hydrogenation treatment may comprise removing aromatics from the oil product. The extraction solvent may comprise n-methyl-2-pyrrolidone. The oil product may comprise at least 90 wt % saturates, such as at least 95 wt % of saturates. The oil product may comprise less than 0.03 wt % of sulfur. The oil product may have a viscosity index of at least 120. The used oil may comprise used motor oil, or used industrial oil, or both. The used oil may be purified to produce the feedstock. Purification of the used oil may comprise subjecting the used oil to distillation to form the feedstock comprising a distillate from the distillation. The method may comprise forming countercurrents of the feedstock and the extraction solvent in a solvent extraction column, wherein the agitation speed and the flow rates of the feedstock and extraction solvent into the solvent extraction vessel are adjusted independently based on a quality or property of the feedstock.

In a further aspect, there is provided a system comprising a purification unit configured to purify used oil, to form a feedstock comprising purified used oil; a continuous counter-current liquid-liquid extraction column for extracting an extract from the feedstock using an extraction agent, the extraction column comprising an agitator configured to agitate the feedstock and the extraction solvent flowing through the extraction column at a variable agitation speed; and a continuous flow liquid phase hydrogenation unit for hydroprocessing the extract extracted by the extraction column to produce an oil product.

In the system of the preceding paragraph, the continuous flow liquid phase hydrogenation unit may comprise a hydrogenation reactor comprising a hydrogenation catalyst; a transport line in fluid communication with the solvent extraction column and the hydrogenation reactor, for transporting the extract from the solvent extraction column to the hydrogenation reactor; a diluent inlet on the transport line, for introducing a diluent into the extract flowing through the transport line to form a liquid mixture comprising the extract and the diluent; and a hydrogen inlet on the transport line located downstream of the diluent inlet, for introducing hydrogen into the liquid mixture. The liquid phase hydrogenation unit may further comprise a guard bed located on the transport line between the diluent inlet and the hydrogen inlet, the guard bed being configured to remove at least phosphorus and silicon from the liquid mixture before exposing the liquid mixture to the hydrogenation catalyst. The hydrogenation catalyst may comprise palladium, gold, or nickel. The purification unit may comprise one or more distillation columns.

Other aspects, features, and embodiments of the present disclosure will become apparent to those of ordinary skill in the art upon review of the following description of specific embodiments in conjunction with the accompanying figures.

BRIEF DESCRIPTION OF THE DRAWINGS

In the figures, which illustrate, by way of example only, embodiments of the present disclosure.

DETAILED DESCRIPTION

Figure 1:
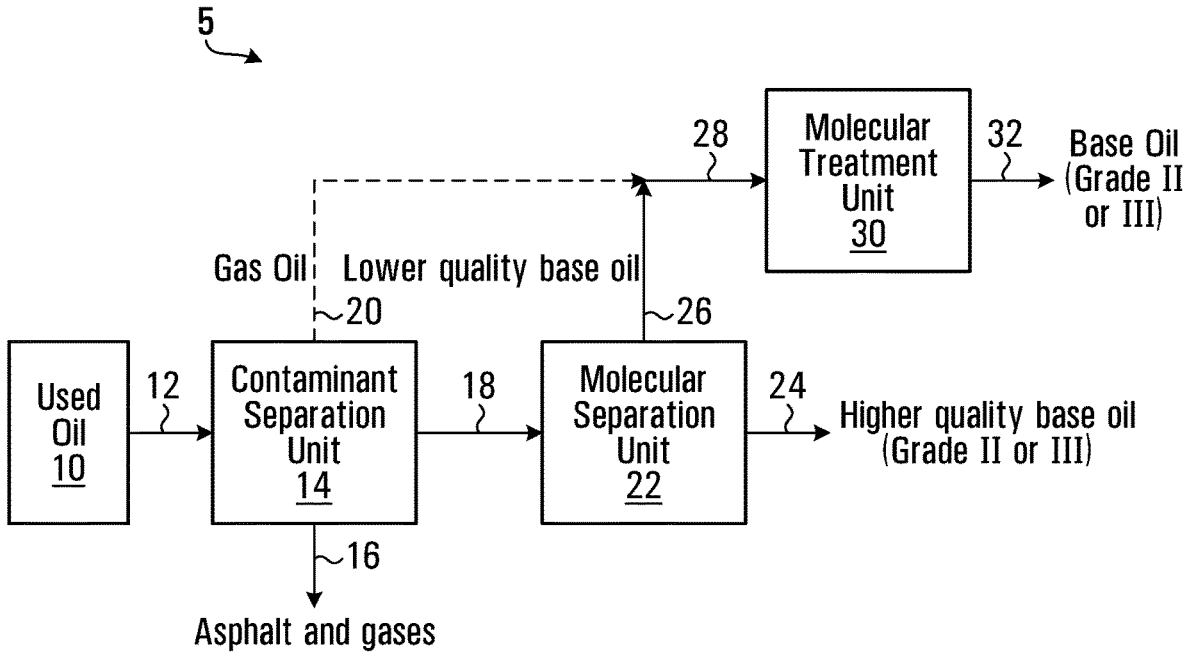
FIG. 1 is a schematic diagram of a system and process for re-refining used oil to produce upgraded base oils and other oil products, according to an embodiment of the present disclosure.

In brief overview, in selected embodiments of the present disclosure, systems and methods are provided for re-refining used motor oils (UMO) or other used oils including used industrial oils. The systems and methods disclosed herein are modified from previously known systems and methods to allow continuous, variable flow rate (particularly low rate) processing, and to allow convenient adjustment to accommodate different input feedstocks including different used oils, which may have substantially different components and properties.

In some embodiments, an example system as described herein can be conveniently adjusted to process or treat used oils from different sources or different types of oils that require upgrade or refining, without having to suspending or stopping operation of the system in order to reconfigure the system. Therefore, the example system may be considered more robust and more adaptable.

In example embodiments, purified oils such as purified used oils are subjected to agitated solvent extraction and liquid phase hydrogenation. This example system is conveniently dynamically adjustable to accommodate different feedstock oils. In particular, agitation in the solvent extract stage allows convenient adjustment of the feedstock flow rate. Hydrogenation in the liquid phase also allows convenient adjustment of the processing flow rate. The example system also allows convenient adjustment of other operation parameters, as will be further discussed below.

Some embodiments of the present disclosure relate to an improved method of producing high quality base oil from used oils.

The term "used oil" as used herein includes any petroleum, or natural or synthetic oils, that have been used, and as a result of such use are possibly contaminated by contaminants or impurities, and thus have deteriorated physical or chemical properties. The used oils are typically of a lower quality than the original un-used oils. Used oils may include waste oils. Used oils may include used motor oils (UMO), or used industrial oils. For example, used oils may include used industrial lubricants. UMO may be obtained from various sources, such as automobiles, passenger motor cars, engines, industrial plants, or the like. Used oils from different sources can have different properties and constituents.

It is noted that used oils are different from crude oils in their compositions and properties. Crude oils refer to oils extracted from subterranean reservoirs. For example, UMO typically contains contaminants that are not present in crude oils, which contaminants may include contaminants introduced during manufacture of the motor oil or during use of the motor oil, and external contaminants such as salt and water. Consequently, the processing and treatment techniques for refining crude oils and re-refining used oils have been quite different in conventional refineries or refining technologies.

Used oils may include used engine oils. Typically, high quality base oils are blended with about 30 wt % performance additives to produce engine oils. These additives are quite often still present in the used engines oils or UMO. The additives may include viscosity modifiers (VM), detergents and dispersants, depressants, antiwear additives, antioxidants, corrosion inhibitors, metal passivators, antifoam additives, sulfur scavengers, or the like.

VMs are typically long chain hydrocarbon polymers, such as olefin copolymers, hydrotreated styrene-butadiene polymers, or hydrotreated styrene-isoprene copolymers, or the like.

Detergents and dispersants are used in the engine oil to keep combustion by-products dissolved in the base oil. Dispersants are typically long chain polymers, commonly derived from poly-isobutene. Detergents typically have an ionic head with a polymeric tail, where the head attracts solids while the tail keeps the molecule in solution. The detergent may include calcium phenate, for example.

The pour point of oil is the lowest temperature at which the oil will flow. Base oils can contain paraffin even after dewaxing. The paraffin crystalizes at low temperatures, thus may cause the viscosity of the oil to increase rapidly. Pour point depressants do not prevent crystallization but they can change the shape of the crystals so as to reduce viscosity increase caused by crystallization of the paraffin. Pour point depressants may include polyalkyl methylacrylates.

Antiwear additives may include compounds having alkyl groups, zinc, and phosphorus, or the like. For example, a suitable antiwear additive may be a zinc dialkyl-dithiophosphate derivative, which may also function as an antioxidant and corrosion inhibitor.

Antioxidants may include primary antioxidants, which may be free radical scavengers for preventing oxidation and sludge formation resulted from oxidation, and secondary antioxidants, which may decompose peroxides formed during oxidation to prevent sludge formation. As noted above, zinc dialkyl-dithiophosphate may be used as a primary antioxidant. Typical secondary antioxidants include organosulfur compounds.

Corrosion inhibitors prevent rusting in the engine. Antirust additives block the oxygen from coming into contact with the iron in the engine block. Zinc dialkyl-dithiophosphate can react with oxygen, and can thus be used as corrosion inhibitors to prevent reactions of oxygen with metals in the engine.

Metal passivators are used to form a film on metals in the engine to prevent the contact of oxygen with the metal. Metal passivators may include hydrocarbons such as 2,5-dimercapto-1,4-thiadiazole derivatives. 2,5-dimercapto-1,4-thiadiazole derivatives can also function as a sulfur scavenger.

To prevent formation of foam in the oil or on the surface of the oil, antifoam additives may be added to oils and may remain in used oils. For example, dissolved liquid silicon is often used as an antifoam agent. Organic polymers may also be used as silicon-free antifoam additives.

Contaminants can be formed or introduced in to the engine oils during use. For example, common external contaminants or contaminants formed by engine ear or material degradation include water, other automotive fluids such as fuel oil and fuel additives, transmission fluids, brake fluids, waste gasoline, non-automotive lubricants or industrial oils such as hydraulic fluids, dirt, salt, sludge, soot, carbonaceous particles, lacquer, oxidation products, or the like. Contaminants formed from the additives or due to engine wear-and-tear may include metals, metallic oxides or particles, and polymers. The contaminants may include zinc, calcium, phosphorus, silicon, or the like. In particular, phosphorus and silicon are difficult to remove by distillation and may poison hydrogenation catalysts. UMO may also contain coolants, such as ethylene and propylene glycol.

Used oils such as UMO may contain about 75 wt % to 80 wt % lube oil molecules, which can re-refined and recovered to form higher quality base oils. In some embodiments, the main contaminants to be removed from the UMO are water, sludge, corrosion precursors and catalyst poisons. The corrosion precursors may include organic chlorides and sulfides, at levels of 10-50 ppm in the UMO.

The used oils may be pre-treated or purified to provide purified used oils. In this disclosure, "purified oils" refer to any used oils or crude oils that have been subjected to one or more purification treatment(s) to remove impurities such as water, light fuel, or other chemical compounds including ethylene glycol, particulate materials, metals, either completely or partially. Water may be removed by a dehydration process. The purification process may also include distillation, such as vacuum distillation. In purified used oils, some impurities or contaminants may still exist. Different purification processes may be used to remove different impurities and contaminants. Depending on the particular application, not all impurities or contaminants need to be removed before refining or upgrading. In some cases, only certain selected types of impurities or contaminants are removed. In some cases, a certain percentage of impurities or contaminants may remain in the purified used oils.

Partially purified oils with various impurities/contaminants at various levels (percentages) may be used in different applications without further purification or re-refining or upgrading. For example, in some relevant industries, partially purified oils may include oils that are referred to as vacuum gas oil (VGO), light VGO (LVGO), heavy VGO (HVGO), marine fuel oil (MGO), or the like, or oils that have similar constituents or properties thereof. However, this disclosure is concerned with further purification and re-refining or upgrading the purified used oils.

Purified oils can also be distillates including partial distillates obtained by distilling used oils. The distillation process may include flash distillation of used oils. In some embodiments, atmospheric distillation or vacuum distillation may also be included. In the relevant industry, the term "distillates" may also refer to diesel fuel, fuel oil, heating oil, or the like. Typically, an oil distillate has a flash point below about 100° F. Typically distillates may also have an initial boiling point (IBP) of 400° F. and a final boiling point (FBP) of 700° F. Typical partial distillates may have an IBP-FBP range that overlaps with the range of 400-700° F. For example, a partial distillate may have an IBP-FBP range of 300-500° F., or 500-800° F.

VGO and MGO are examples of distillates.

Some embodiments disclosed herein relate to a process and system for treating used oil in a pre-treatment facility, such as a contamination separation unit (CSU), to separate and remove various contaminants from the used oil and obtain a partially purified oil fraction.

Because at least some potential contaminants can cause plugging, fouling, or corrosion in the downstream processing facilities, removing such contaminants can reduce or avoid plugging, fouling and corrosion, and improve the overall system performance and efficiency.

In some embodiments, the purified oil is treated in a solvent extraction unit, also referred to as a molecular separation unit (MSU), to separate solvent soluble compounds from solvent insoluble compounds in the feedstock. Depending on the extraction solvent used, the extracts extracted by the solvent in the extract stream may contain lower quality base oil, and the un-extracted fraction of the feedstock (referred to as the raffinate, or raffinate stream) may contain higher quality base oil. Typically, the extraction solvent and the extraction conditions may be selected to separate and remove oxygenates, non-saturates (unsaturated hydrocarbons), and aromatics (aromatic hydrocarbons), from the saturates (saturated hydrocarbons) in the feedstock. The treatment can also improve the color index of the raffinate stream.

The extracts from the solvent extraction process, which contains a lower quality base oil fraction, is subjected to a continuous flow liquid phase hydrogenation process to produce a higher quality oil product, which may include high quality base oil, ultra-low sulfur diesel, or naphtha. The hydrogenation process is used to remove aromatics and other undesirable materials and convert non-saturates to saturates. It is desirable to convert as much non-saturates as possible to saturates, if economically and technically feasible and practical. Saturates are desirable because they are more stable and less likely to degrade over time or under severe conditions such as when exposed to heat, moisture, or reactive agents such as reactive gases.

The oil product obtained in a process as described herein may contain oils that have a boiling point between 550° F. and 1050° F., and may contain $C_{18}$ to $C_{40}$ hydrocarbons (i.e., hydrocarbons with 18 to 40 carbon atoms).

Typically, used base oils and finished lubricating oils, by usage or handling, can become contaminated with oxidation and degradation products, water, fuels, solvents, antifreeze, other oils, fine particulates, additive products and the like. Usage can also cause changes in the molecular structure of the hydrocarbons or chemical additives in the oils. These contaminants or changes may reduce the performance of the used oils or render the oils unsuitable for use in their intended services and necessitate disposal or replacement with new, uncontaminated oil. Once deemed unfit for use or service, these contaminated oils are typically called used oil or waste oil. Used oil can be either petroleum or synthetic oil. Used oils may include oils that are used as motor oils for automobiles, cars, trucks, or other transportation vehicles; as lubricants for engines, turbines, or gears; as hydraulic fluids, metal working fluids, insulating fluids, cooling fluids, or process fluids; or the like.

The treatment of the used oil in the CSU may include distilling the used oil stream to separate at least a portion of the input material having a boiling point less than about 350° F. from the used oil to produce a de-volatized oil fraction and a light oil fraction.

The de-volatized oil fraction is treated to separate at least a portion of material with a boiling point greater than about 350° F., to produce a fuel oil fraction and a heavy oil fraction.

The heavy oil fraction is treated to separate at least a portion of material with a boiling point from about 650° F. to less than 1200° F. to produce a partially purified oil fraction and a residual fraction.

In some embodiments, the light oil fraction is separated from the de-volatized oil fraction by distillation, such as at least one of atmospheric distillation or vacuum distillation.

In some embodiments, the fuel oil fraction is separated from the heavy oil fraction by at least one of atmospheric distillation or vacuum distillation. In some embodiments, the partially purified fraction is separated from the residual oil fraction by vacuum distillation.

As can be understood, the CSU may be configured and designed to make preliminary separation of useful oil fractions from some of the undesirable materials and low quality oils. The undesired materials than can be removed at this stage may include heavy materials, such as asphalt, and some contaminants which may be removed with asphalt. To facilitate removal of certain materials, selected additives may be added into the treatment stream. The contaminants that can be removed may also include acidic compounds, additives added to the motor oils during manufacture, gums, varnish, dust particles, or the like. The materials that can be removed at this stage may also include light materials, such as water, glycol, coolants, antifreezes, or the like. Gases such as light gasoline components may also be removed in the CSU.

The partially purified oil fraction from the CSU is then subjected to solvent extraction, in a solvent extraction column or the MSU, to separate a high quality base oil fraction from a low quality base oil fraction in the purified oil.

The extraction solvent may be selected to extract primarily aromatics and polar compounds.

The extraction solvent may be n-methyl-2-pyrrolidone (NMP). In some embodiments, NMP may be used in combination with one or more other solvents. For example, a mixture of NMP and phenol may be used for solvent extraction. The extraction solvent may also contain a minor amount of water.

In different embodiments, the extraction solvent may be selected from ethanol, diacetone-alcohol, ethylene-glycol-mono(low alkyl) ether, di-ethylene-glycol, diethylene-glycol-mono(low alkyl) ether, o-chlorophenol furfural, acetone, formic acid, 4-butyrolacetone, water, aqueous salts, low-alkyl-ester of low mono- and dicarbonic acids, dimethylformamide, 2-pyrrolidone and N-(low alkyl)2-pyrrolidone, N-methyl-2-pyrrolidone, mono or poly protic acids, mineral acids, carboxylic acids, hydroxide bases, carbonate bases, mineral bases, epichlorohydrin, dioxane, morpholine, low-alkyl- and amino(low-alkyl)morpholine, benzonitrile and di-(low-alkyl)sulfoxide and phosphonate.

The solvent extraction column may be designed to limit entrainment and enable good separation of the oil and the extractant phases.

In some embodiments, the extracts from the MSU may be treated by a hydrogenation treatment in a hydrogenation unit, also referred to as the molecular treatment unit (MTU) or hydroprocessing unit herein, to improve their oil quality. The hydrogenation process may include adding a hydrogen diluent to a stream of the extract from the MSU to form a continuous liquid phase diluent and feed mixture. Hydrogen is then added to the diluent and feed mixture to form a continuous liquid phase feed, diluent and hydrogen mixture.

The continuous liquid phase feed, diluent and hydrogen mixture is then reacted in the presence of a hydrogenation catalyst to remove selected compounds from the feed mixture, and thereby obtaining high quality base oil, ultralow sulfur diesel, or naphtha.

In some embodiments, the continuous flow liquid phase hydroprocessing step may be conducted in a hydrogenation reactor at a predetermined temperature. The reactor may be configured to have an upper zone of gases and a substantially larger lower zone of hydrogen dissolved in a mixture of liquids surrounding the hydrogenation catalyst.

The method further includes the steps of subjecting the used oil stream to ozonation, oxidation, acid treatment and/or magnetic filtration, prior to being fed to the contamination separation unit, and/or subjecting the partially purified oil fraction to ozonation, oxidation, acid treatment and/or magnetic filtration, prior to being fed to the contamination separation unit.

Ozonation can be carried out with a mixture of ~1.2% ozone in oxygen. As the interface between gas and liquid (oxygen & used oil) is important, a packed column can be used for a more efficient use of ozone. Oxidation can be carried out with hydrogen peroxide (50%) and ultraviolet (UV) light.

Acid treatment can involve treatment with an organic acid such as glacial acetic acid, with an oil to acid ratio of 10:1.

Magnetic filtration can be carried out by methods known in the art.

In some embodiments, the used oil stream can be pretreated with chemical additives prior to entering contaminant separation unit. The chemical additives may include additives selected from butanol, amines, sodium, and hydrogenation agents, or combinations thereof.

A specific embodiment is illustrated in FIG. 1, which shows a schematic diagram of a system 5 for re-refining and upgrading used oils including UMO and other waste oils.

System 5 includes a feedstock container 10, a contaminant separation unit (CSU) 14, a molecular separation unit (MSU) 22, and a molecular treatment unit (MTU) 30. A transport line 12 connects the feedstock container 10 to CSU 14. An outlet line 16 is provided to discharge contaminants and impurities separated from the feedstock in the CSU 14. A transport line 18 connects an outlet of the CSU 14 to an inlet of the MSU 22 for transporting purified base oil from the CSU 14 to the MSU 22. The MSU 22 has an outlet line 24 for output of a raffinate stream produced in the MSU 22. A transport line 26 connects an outlet of the MSU 22 to an inlet of the MTU 30 to transport the extract stream formed in the MSU 22 to the MTU 30 for further processing. A transport line 28 connects an outlet line 20 of the CSU 14 to the inlet of the MTU 30 to transport gas oil separated from the purified oil in the CSU 14 to the MTU 30 for further processing.

The CSU 14 is structured and configured to separate and remove physical contaminants including asphalt from base oil constituents (base oil fraction) in the feedstock. In particular, the outlet line 16 may be used to discharge the removed contaminants or impurities, the transport line 18 may be used to output the purified base oil fraction in the liquid phase, and the outlet line 20 may be used to output the separated oils in the gas phase.

Figure 2:
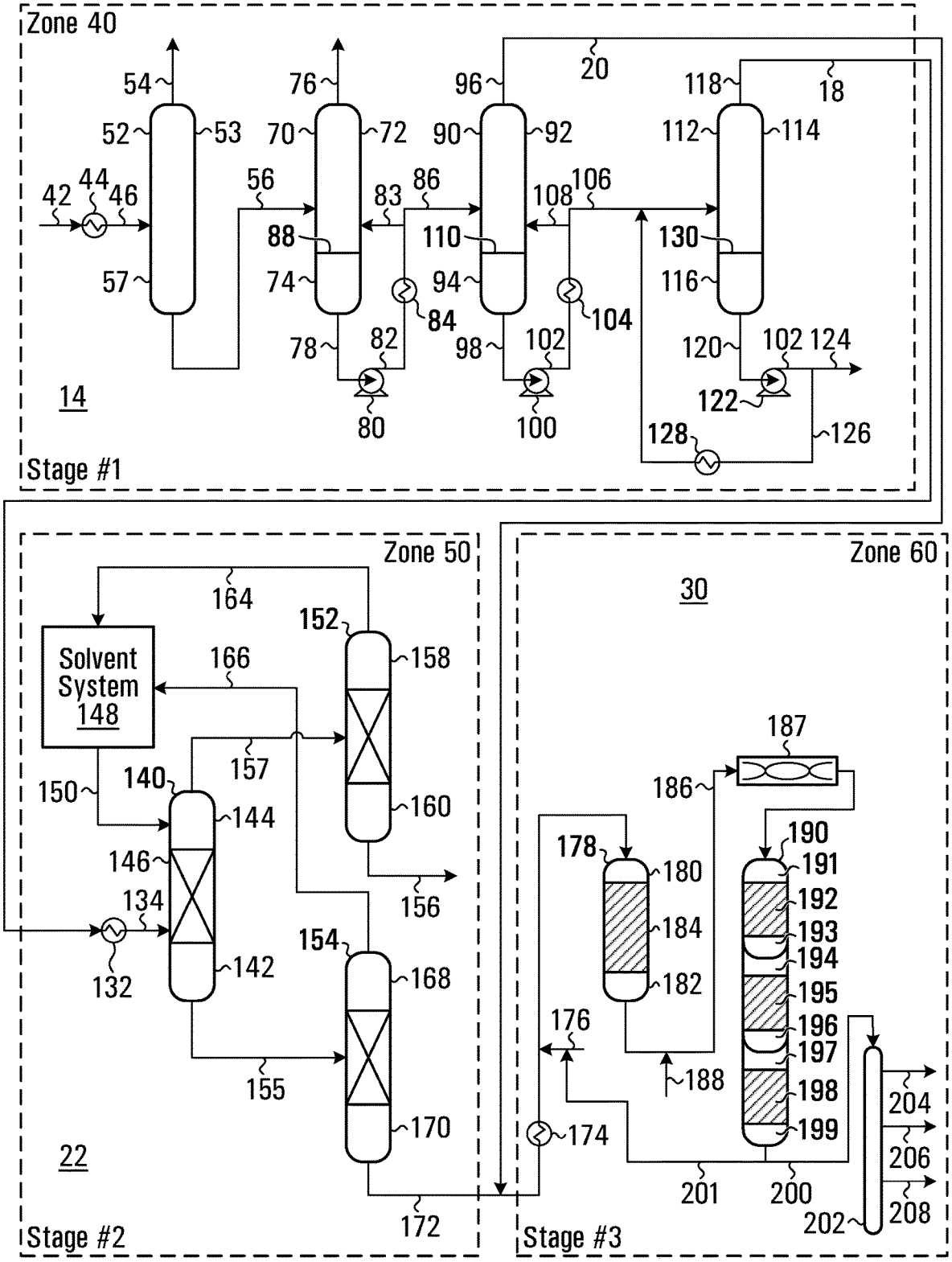
FIG. 2 is a schematic diagram of a particular example of the system of FIG. 1, including a contaminant separation unit, a molecular separation unit, and a molecular treatment unit.

A specific example configuration of the CSU 14 is illustrated in FIG. 2 (see Stage #1).

The CSU 14 may include a packed tower, commonly referred to as a packed column. For example, the packed column may be in the form of a generally cylindrical vessel filled with packing materials. The feedstock is typically circulated from the top to the bottom, and a purifying agent such as soda ash may be injected in the liquid phase into the column at the top of column. The soda ash may be injected using spray nozzles provided at the top of the column.

In some embodiments, the CSU 14 includes a vacuum separation column, instead of a thin film evaporator commonly used for separating contaminants in crude oil refineries.

The CSU 14 is typically used as part of the pre-treatment of the feedstock. The CSU 14 may also include a distillation facility for removing water and other impurities or contaminants based on the boiling points or vapor pressure of the materials.

During operation, the feedstock stored in container 10 is introduced into the CSU 14 through the transport line 12, such as using a pump or any suitable conveyance equipment. The flow rate in the transport line 12 may be controlled using the transport pump, or a flow control valve (not shown).

The feedstock may include used oils, such as UMO or used industrial oils, or a combination thereof. While UMO is sometimes referred to herein when describing and illustrating the operation of the process and system as depicted in the drawings, other used oils may also be used as or in the feedstock.

The feedstock may contain various contaminants, which may include water, light hydrocarbons, solvents, solids, polymers, high molecular weight hydrocarbons, lubricating oil additives, chemicals, salts, and the like.

At least some of the physical contaminants or impurities are removed from the feedstock in the CSU 14.

Various physical contaminants may be removed from the base oil fraction and the gas fraction. The removed physical contaminants may be separated into more than one output streams through more than one outlet lines. The removed physical contaminants may include low molecular weight materials such as water, glycols, asphalts, or the like. The removed contaminants may also include impurities in the gas phase.

Some sulfur in the feedstock may also be removed in the CSU 14. Sulfur may be reacted with a chemical agent to form precipitates. The precipitates can then be removed with other separated contaminants such as asphalts.

Several processes or combination of processes can be used to effect separation in the CSU, including various forms of extraction, distillation, filtration, centrifugation, absorption, adsorption, or the like, as known to those skilled in the art. Typically, separation will be effected based upon some differences in physical or chemical properties of the materials to be separated.

Various convention systems and techniques may be used to effect separation in the CSU 14.

The CSU 14 can thus be used to purify the feedstock and produce purified oil. The purified oil may include purified based oil. For example, if the feedstock includes UMO, the purified oil output fraction at line 18 could include purified base oil. It is not necessary that the purified oil output through line 18 is completely purified. The purified oil fraction at line 18 contains a reduced proportion of impurities or contaminants, as compared to the feedstock.

The base oil fraction extracted through outlet line 18 may include saturated and unsaturated hydrocarbons suitable for use as, or for further processing to produce, base oils. Suitable hydrocarbon molecules typically have 18 to 40 carbon atoms and having a boiling temperature of about 500° F. to about 1200° F. at 1 atm.

The base oil fraction extracted from line 18 is introduced into the MSU 22 to undergo an agitated liquid-liquid solvent extraction process, to produce an extract stream containing lower quality base oils, which are extracted through line 26 and transported to the MTU 30 for further processing, and form a raffinate stream containing higher quality base oils, which are output through outlet line 24.

The raffinate stream contains higher quality base oils that may meet the Group II or Group III base oil standards, and may be used as Group II or III base oils. They may be commercially sold without further processing or treatment, or may be further processed, such as to include desired additives.

The extract stream from the MSU 22 includes low quality oils that may or may not meet the Group I base oil standard, and is subjected to a continuous flow liquid phase hydrogenation process in the MTU 30, to increase the saturate level and the viscosity index and reduce the sulfur level. The treatment in the MTU 30 may also remove aromatics and various elemental contaminants from the raffinate stream. For example, the extract stream may include elemental sulfur attached to hydrocarbons. Such sulfur containing compounds may react with hydrogen to form $H_2S$ gas and saturated hydrocarbons, thus detaching sulfur from the hydrocarbons. The $H_2S$ gas may be separated from the liquid stream containing increased saturates. Other possible contaminants that may be present in the raffinate stream and may be removed at the MTU 30 may include polymers, metals, phosphorus, silicon, or the like. The process in the MTU produces an oil product with increased quality in terms of saturate level, sulfur level, and viscosity index, and possibly others. The products from the MTU 30 may include a high quality base oil fraction, ultralow sulfur diesel, or naphtha, or a combination thereof. The high quality base oil may meet the Group II or III standard, as set out in API 1509.

In some embodiments, at least a fraction of the gas oil obtained in CSU 14 may also be introduced into the MTU 30 through transport line 20, either separately, or with the extract stream from the MSU 22 through transport line 28.

In the MSU 22, the purified oil stream is separated into at least two streams by solvent extraction. The extract stream typically contains significant amounts of oxygenates, aromatics (aromatic hydrocarbons), non-saturates (unsaturated hydrocarbons), and may also contain a low level of saturates. The extracts may include polar compounds, aromatic hydrocarbons, olefins, non-saturates, heteroatoms, or the like. The extract stream also initially contains most of the extraction solvent, which can be subsequently separated and removed, as will be further discussed below. The extract is considered to contain a lower quality base oil, because it has a lower level of saturate and a lower viscosity index (VI).

The raffinate stream that is separated from the extract stream may contain base oils of a higher quality, because the raffinate stream may have a higher level of saturate, a lower level of sulfur, and a relatively higher VI. The raffinate stream may also have a reduced level of aromatics. The saturates in the raffinate stream are typically paraffinic and non-aromatic.

The raffinate stream with higher quality base oils may be output through outlet line 24 to provide a base oil product. The base oil product may contain at least 90 wt % saturates and less than 0.03 wt % sulfur, and have a VI of at least 120. In some cases, the base oil product extracted from output line 24 may contain at least 95 wt % saturates.

Depending on the nature of the feedstock, and processes implemented in the CSU 14 and MSU 22, the extract stream output at line 26 typically contains higher concentrations of undesirable materials such as sulfur, oxygen, nitrogen, olefins, aromatics, and the like.

Various processes or combinations thereof may be used to effect separation or removal of these undesirable materials from the saturates in the extract stream, and to saturate the non-saturates by hydrogenation. For example, the MSU 22 or MTU 30, or both, may include facilities or subunits for performing various forms of extraction, filtration, ultrafiltration, absorption, adsorption, hydrogenation, or the like, and may use known techniques such as catalysts and molecular sieves to assist or enhance processing and performance.

In the MTU 30, the extract from the MSU 22 is processed under continuous flow liquid phase hydrogenation conditions to increase the saturate level and the VI, and possibly reduce the sulfur level and the level of aromatics. The oil product produced in the MTU 30 may include base oils containing at least 90 wt % saturates and less than 0.03 wt % sulfur, and having a VI of at least 80. In some embodiments, the oil product may contain at least 95 wt % saturates, and the VI may be 120 or higher. The oil product may also include ultra-low sulfur diesel, and naphtha. The oil product may be extracted through outlet line 32.

The oil product extracted from line 32 may be of a quality sufficient to meet the Group II or III standard as set out in API 1509.

FIG. 2 illustrates further details of the system 5 according to a specific embodiment.

As can be seen in FIG. 2, the CSU 14 may be implemented in zone 40 for a first stage (Stage #1) processing and treatment, the MSU 22 may be implemented in zone 50 for a second stage (Stage #2) processing and treatment, and the MTU 30 may be implemented in zone 60 for a third stage (Stage #3) processing and treatment.

At Stage #1, the CSU 14 in zone 40 includes a distillation system for separating base oil fraction from other components in the feedstock introduced through input line 42.

The zone 40 system includes an input line 42, heaters 44, 84, 104, 128, transport lines 46, 54, 56, 76, 78, 82, 83, 96, 98, 102, 106, 108, 118, 120, 124 and 126, a first flash distillation vessel 52, a second in-situ flash distillation vessel 70, a third vacuum distillation vessel 90, a fourth vacuum distillation vessel 112, pumps 80, 100, 122.

The flash distillation vessel 52 includes a top 53 and a bottom 57. Line 54 is a distillate output line of the flash distillation vessel 52 for outputting the distillate stream produced therein. Line 56 is a bottom outlet line for transporting the bottom stream formed in flash distillation vessel 52 to the flash distillation vessel 70.

The flash distillation vessel 70 includes a top 72 and a bottom 74. Line 76 is a distillate output line of the flash distillation vessel 70 for outputting the distillate stream produced therein. Line 78 is a bottom outlet line for transporting the bottom stream formed in flash distillation vessel 70 through pump 80, line 82 and heater 84, to the flash distillation vessel 90 through line 86, or to the recycling line 83 that feeds back into the flash distillation vessel 70. Pump 80 drives the fluid flow in transport lines 78, 82, 83, and 86. Heater 84 heats the fluid transported through line 82.

The vacuum distillation vessel 90 includes a top 92 and a bottom 94. Line 96 is a distillate output line of the vacuum distillation vessel 90 for outputting the distillate stream produced therein. Line 98 is a bottom outlet line for transporting the bottom stream formed in vacuum distillation vessel 90 through pump 100, line 102 and heater 104, to the vacuum distillation vessel 112 through line 106, or to the recycling line 106 that feeds back into the vacuum distillation vessel 90. Pump 100 drives the fluid flow in transport lines 98, 102, 106, and 108. Heater 104 heats the fluid transported through line 102.

The vacuum distillation vessel 112 includes a top 114 and a bottom 116. Line 118 is a distillate output line of the vacuum distillation vessel 112 for outputting the distillate stream produced therein. Line 120 is a bottom outlet line for transporting the bottom stream formed in vacuum distillation vessel 112 through pump 122, line 124 to provide an oil product or further processing, or to recycle the bottom stream (or a portion thereof) back to the vacuum distillation vessel 112 through line 126, heater 128, and line 106. Pump 122 drives the fluid flow in transport lines 120, 124 and 126. Heater 128 heats the fluid transported through line 126.

During operation, the feedstock is introduced through lines 42, 46 and heater 44 into the first flash distillation vessel 52, and subjected to a distillation process. The distillation temperature in vessel 52 is controlled and adjusted to allow boiling of water and low boiling point hydrocarbons. A typical distillation temperature, depending of the used oil feed and the operating pressure selected, may be in the range of from about 190° F. to about 210° F. The distillate stream is produced and collected at the top 53 of the flash distillation vessel 52, which has a boiling point of up to about 350° F. at 1 atm. As can be appreciated, a distillate having such a boiling point includes light oils. The distillate is recovered via line 54, and may be used fuel oil, or the like. The bottom stream formed and collected at the bottom 57 may include devolatilized oil fraction in the feedstock, and is withdrawn through the bottom outlet and line 56, and transported to the in-situ flash distillation vessel 70.

The first distillation process separates and removes light hydrocarbons and water from the bottom stream of vessel 52.

The bottom stream of vessel 52 is subjected to further distillation in vessel 70. The distillation temperature in vessel 70 may be in the range of from about 280° F. to about 295° F. A distillate stream produced and collected at the top 72 of vessel 70 is output through outlet line 76. A bottom stream formed at the bottom 74 of vessel 70 is discharged through outlet line 78 for recovering a portion of a liquid layer maintained in the lower portion of vessel 70 at a liquid level shown at 88.

The distillate stream recovered from line 76 has a boiling point of generally from about 350° F. to about 500° F. The distillate stream of vessel 70 can thus be used as fuel oil.

The bottom stream formed at vessel 70 contains heavy oil. A fraction of the bottom stream of vessel 70 may be recycled back through line 78, pump 80, feed inlet line 82, heater 84, and line 83. Another fraction of the heated bottom stream in line 82 may be transported through line 86 to the third vacuum distillation vessel 90.

The heated bottom stream of vessel 70 is further distilled in vessel 90. The distillation temperature in vessel 90 may be in the range of about 280° F. to about 320° F. The distillate stream formed and collected at the top 92 of vessel 90 also contains oils that can be used as fuel oil. The distillate stream has a boiling point of from about 500° F. to about 650° F.

In this vacuum distillation process, non-volatile fractions including fuel fraction, gas oil, and heavy residual oil are separated.

The bottom stream formed and collected at the bottom 94 of vessel 90 contains heavy oil. A portion of the bottom stream is recycled back to the vessel 90 after it is heated by heater 104, through lines 98, 102, 108 and pump 100. A portion of the heated bottom stream is passed through line 106 as a feed to the fourth vacuum distillation vessel 112. A liquid volume at the liquid level 110 is maintained at the lower portion of vessel 90.

The returned heated bottom streams for vessels 70 and 90 are used to maintain the temperatures in the liquid layers at the bottom 74 or 94 of the vessels 70 and 90 respectively.

The feeds into vessels 70 and 90 are heated to sufficiently elevated temperatures necessary to effect the desired separation of the distillates by direct contact with the liquid layer in the bottom of the vessels 70, 90.

The fraction of bottom stream fed into vessel 112 from vessel 90 is subjected to further distillation in vessel 112, at a higher temperature, up to about 560° F. Vessel 112 is configured and operated to produce a distillate stream at the top 114, which has a boiling temperature from about 650° F. to about 1200° F. The distillate stream is output through distillate outlet line 118.

A liquid level 130 is also maintained at the bottom 116 in vessel 112. A portion of the bottom stream formed at the bottom 116 is heated and recycled back to vessel 112 through line 120, pump 122, heater 128, and line 106. The returned heated bottom stream helps to maintain the desired feed temperature to vessel 112. The other portion is discharged through line 124, and may be used as a product or subjected to further processing. For example, the output from line 124 may be transported to a storage container (not shown) for storage.

Depending on the original feedstock, the bottom stream recovered through line 124 typically includes asphalt, polymers, high boiling point hydrocarbons, salts, solids, other high boiling point materials, which have a boiling point greater than 1200° F.

In some embodiments, vessel 112 may be a vacuum distillation vessel, for example to prevent degradation of any base oil fractions in the feed to the vessel 112. Steam or gas stripping may also be used in vessel 112 to enhance distillation.

The distillate stream recovered from vessel 112 at line 118 contains purified used oil. The purified used oil may be partially purified as discussed earlier. The purified used oil is transported to the MSU 22 in Zone 50 for further processing and treatment at Stage #2, including agitated solvent extraction.

The MSU 22 in zone 50 includes a heat exchanger 132, an agitated counter-current liquid-liquid extraction column 140, a solvent system 148, a vessel 152, and a solvent separation vessel 154, and transport lines 134, 150, 155, 156, 157, 164, 166, 172 interconnecting them. For brevity, the agitated counter-current liquid-liquid extraction column 140 is also referred to as the solvent extraction column 140.

The heat exchanger 132 is configured and positioned to heat the distillate stream from the outlet 118 of distillation vessel 112, before the distillate is introduced into the solvent extraction column 140 through line 134.

The solvent extraction column 140 has a bottom 142, a top 144, a contact section 146 between the bottom 142 and the top 144, an inlet connected to the transport line 150 for introducing an extraction solvent into the solvent extraction column 140, a top outlet connected to the transport line 157, and a bottom outlet connected to the line 155.

The solvent extraction column 140 also includes a variable speed agitator (not separately shown in FIG. 2, but see FIG. 3) configured and operable to agitate the purified oil and the extraction solvent flowing in the solvent extraction column 140, at a variable agitation speed. The agitation speed could be controlled independent of the flow rates of the fluids in the solvent extraction column 140. The agitator may be a rotary agitator, reciprocal agitator, pulsed agitator, or the like.

A particular example of the solvent extraction column 140 is a countercurrent liquid extractor known as the Scheibel column in the art. A general description of a Scheibel column is provided in U.S. Pat. No. 2,493,265 to Scheibel, entitled "Extraction Apparatus" and published in 1950. A suitable Sheibel column may be a vertical column in which the purified oil and the extraction solvent are contacted in a counter current fashion.

Figure 3:
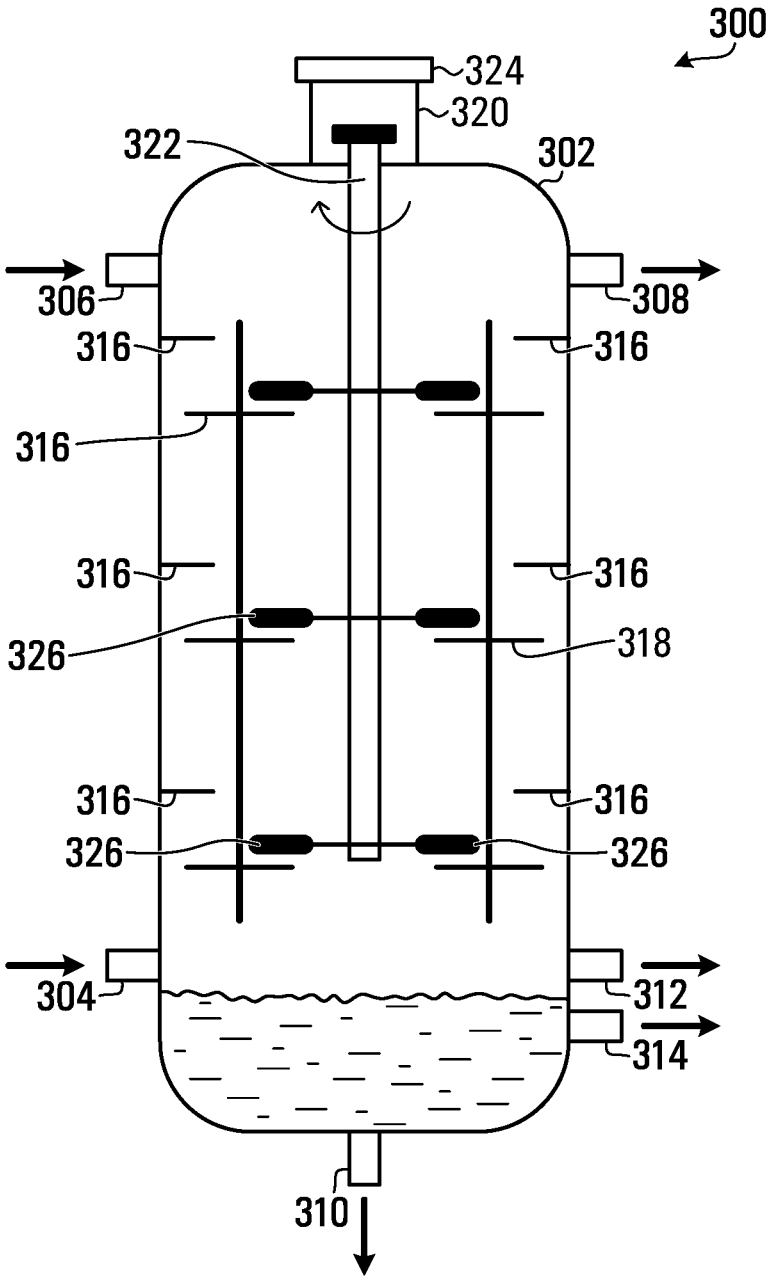
FIG. 3 is a schematic view of an example continuous countercurrent liquid-liquid solvent extraction column with a variable speed agitator.

FIG. 3 schematically shows the basic structure of a typical Scheibel extraction column 300 that can be used as column 140. The extraction column 300 includes a vertical vessel 302, a lower inlet 304 for introducing a first liquid phase into the column 300, an upper inlet 306 for introducing a second liquid phase into the column 300, an upper outlet 308 for outputting the first liquid phase, a bottom outlet 310 for outputting the second liquid phase, and two inlet/outlet ports 312, 314 for interface control. The first liquid phase is the lighter phase and the second liquid phase is the heavier phase. For example, when the extraction solvent is NMP and the feedstock includes base oils are that are lighter than NMP, the NMP solvent is the heavier phase and will be introduced into the column through the top inlet 304, and the feedstock will be introduced into the column through the lower inlet 302.

The extraction column 300 has an internal chamber and a number of horizontally mounted baffles 316, 318 configured and located to improve mixing and contact of the counter currents in the chamber as the two liquid phases flow in opposite directions through the chamber. Baffles 316 are outer baffles, and baffles 318 are inner baffles. As can be appreciated, the baffles 316, 318 are arranged to improve mixing efficiency.

An agitator 320 is provided to agitate the liquid phases when they pass through the extraction column 300. The agitator 320 includes a rotatable shaft 322 extending vertically through the center of the column chamber, a variable speed driver 324 for actuating and driving the shaft 322. A number of turbine impellers 326 are attached to the shaft 322 and positioned to avoid contact with the inner baffles 318. When the shaft 322 is rotated by driver 324, the impellers 326 will agitate the liquid phases in the extraction column to further improve mixing and contact. Thus, even when the liquid phases flow at relatively high rates, effective mixing of the two liquid phases and efficient solvent extraction can still be achieved. The agitation speed or rotation speed of the shaft 322 can be controlled and adjusted depending on the flow rates and other operation parameters or conditions.

The solvent system 148 is configured to process and store an extraction solvent. The extraction solvent may be NMP. The solvent system 148 is connected to the solvent extraction column 140 by transport line 150 for supplying the extraction solvent stored in the solvent system 148 to the solvent extraction vessel 140. The solvent system 148 has a first inlet connected to line 164 for receiving recycled solvent from vessel 152, and a second inlet connected to line 166 for receiving returned solvent from the solvent separation vessel 154.

The vessel 152 has a top 158, a bottom 160, an inlet connected to the line 157, a top outlet connected to line 164, and a bottom outlet connected to line 156.

The solvent separation vessel 154 has a top 168, a bottom 170, an inlet connected to line 155 for receiving the bottom fraction from the solvent extraction vessel 140, a top outlet connected to the line 166 for returning the separated extraction solvent back to the solvent system 148, and a bottom outlet connected to the line 172 for transporting an extract stream separated out in the solvent separation vessel 140 to the hydroprocessing unit in zone 60 for the next stage, Stage #3, hydroprocessing.

In operation, the distillate stream in line 118 is passed through the heat exchanger 132 and line 134 to the solvent extraction column 140 as the feedstock for the solvent extraction process. The feedstock includes the purified oil as discussed above. The feedstock is driven to flow upward forming an upward current in the contact section 146. The extraction solvent provided from the solvent system 148 is introduced to the top 144 of the solvent extraction column through line 150, and is driven to flow downward forming a downward current in the contact section 146. The extraction solvent and the feedstock thus come into contact as counter currents. The extraction temperature in the contact section 146 is maintained at a temperature below the threshold temperature at which the extraction solvent and the oil components in the feedstock become completely miscible. For example, when NMP is used, optionally with a low concentration of water (e.g. up to 1 vol %), the extraction temperature may be in the range of about 100° F. to about 150° F. The volume ratio of the extraction solvent to the feedstock may be from about 1 to about 4, depending on the quality and properties of the feedstock and the selected flow rates. Compounds in the feedstock that are soluble in the extraction solvent at the extraction temperature are dissolved and dispersed in the extraction solvent and thus separated from compounds in the feedstock that have a lower solubility or insoluble in the extraction solvent at the extraction temperature. The dissolved compounds are extracts, as they are "extracted" by the solvent. The non-dissolved and unextracted compounds, commonly referred to as the raffinate, and are output as the raffinate stream through line 157 to the solvent separation vessel 152. The raffinate stream also contains a small portion of the extraction solvent (such as less than 10 vol %). The extract stream includes the extraction solvent and the extracted compounds (extract), moves downward and is output through line 155 to the solvent separation vessel 154.

The ratio of the flow rate of the extraction solvent to the flow rate of the feedstock may be adjusted depending on the oil quality of the feedstock. For example, the flow rates may be adjusted so that the solvent to feedstock ratio in the contact section 146 may be from about 1 to about 4. In some embodiments, the solvent to feedstock ratio may be about 3 or about 2.5.

Conveniently, with the variable speed agitator, the agitation speed can be controlled and adjusted without affecting the flow rates. The agitation speed may be selected and controlled based on the quality and properties of the feedstock and the selected flow rates.

The contact section 146 is heated so that the desired extracts will have sufficiently high solubility to dissolve and disperse in the extract stream containing the extraction solvent. The temperature is not too high so that selected hydrocarbons will not dissolve in the extraction solvent and will remain in the raffinate stream.

The temperature in the solvent extraction column may be selected and controlled based on the quality and properties of the feedstock, accordingly to known technology or knowledge. Even when the flow rates are slow, the feedstock and the extraction solvent can be sufficiently and quickly mixed for contact by the agitator.

The variable speed agitator thus provides increased efficiency and allows convenient control and adjustment to accommodate possible variations in the feedstock.

The raffinate stream may include higher quality base oil. The raffinate stream is transported from the top of solvent extraction column 140 to separation vessel 152 through line 157. The higher quality base oil is separated from the extraction solvent in the separation vessel 152, such as by heating to a temperature above the boiling point of the solvent and below the boiling point of the base oil. The separated solvent is returned or recycled back to the solvent system 148 through line 164. The separated base oil is output through line 156, and may be used as, or further processed to provide, a high quality base oil product, which may meet the Group II or III base oil standard as specified by API 1509. In some embodiments, the base oil product may meet the Group I base oil standard. Line 156 may provide the oil product directly or indirectly to output line 24.

Some extraction solvent is recovered through line 164 and returned to the solvent processing and storage system 148.

The extract stream comprising the extraction solvent and dissolved or dispersed oil is extracted at the bottom of the solvent extraction column 140 through line 155, and introduced into the solvent separation vessel 154. The compounds dissolved or dispersed in the solvent typically include low quality base oil.

The extraction solvent is separated from the lower quality base oil in the solvent separation vessel 154, such as by heating and distillation.

The separated extraction solvent is recovered from the top 168 of the solvent separation vessel 154, and returned to the solvent system 148 through line 166.

In the solvent system 148, the recycled solvent from both lines 164 and 166 may be treated to remove water and low boiling point contaminants, to neutralize its acidity, or to otherwise improve the quality of the recycled solvent, using techniques known to those skilled in the art. The treated solvent is stored in the solvent system 148 for repeated use.

The lower quality base oil separated out in the vessel 154 is passed via the line 172 to the third stage, Stage #3, for further treatment in the MTU 30 in zone 60.

At Stage #2, depending on the quality and properties of the feedstock, the ratio of recirculation may be adjusted to optimize the solvent extraction process.

The solvent extraction process can also conveniently be adjusted or modified with the assistance of the variable speed agitator to respond to changes in Stage #1, or Stage #3, or the quality and properties in the feedstock. Thus, the entire system 5 is more adaptive than a batch system or a system with continuous solvent extraction but without agitation or adjustable agitation speed. The system 5 is thus more robust.

The MTU 30 in zone 60 is a continuous flow liquid phase hydroprocessing unit.

In previous or conventional systems for re-refining used oils, hydrogenation is typically carried out in the gas phase. It has now been recognized that with a liquid phase hydrogenation process, in combination with the other units in zone 40 and zone 50, a system or process as described herein can provide better temperature control, maintain continuous operation for an extended period, easier to adjust or modify without suspending the operation or process flow. Further, the lifetime of the hydrogenation catalyst used in the hydrogenation process may be prolonged, as will be further discussed below. In particular, because the input and output flow rates in the solvent extraction stage may be variable and can be reduced to low flow rates in embodiments described herein, the MTU 30 and the liquid phase hydrogenation process are designed to operate effectively and efficiently even at lower throughput or feedstock flow rates.

The MTU 30 in zone 60 includes a heat exchanger 174 located on the transport line 172 for heating the extract stream from the solvent separation vessel 154, a diluent inlet 176 on the transport line 172, a guard bed 178 downstream of the diluent inlet 176, a mixer 187, a hydrogen injection inlet 188 located downstream of the diluent inlet 176 and upstream of the mixer 187, a hydrogenation reactor 190, a stripper/fractionation unit 202, and transport lines 186, 188, 200, 201 for interconnecting them as shown in FIG. 2.

The guard bed 178 has a top 180, a bottom 182, and a contact zone 184. In some embodiments, the contact zone 184 may contain a spent catalyst, activated clay, or the like, which are selected to remove contaminants, such as silicon and phosphorus, from liquids passing through the guard bed 178, where the contaminants may have a negative effect on the hydrogenation catalyst in the hydrogenation reactor 190. Thus, the guard bed 178 guards the hydrogenation reactor 190.

The mixer 187 is configured to agitate the liquid mixture therein, and sufficiently mix hydrogen injected through the hydrogen inlet 188 with the purified liquid mixture before the liquid mixture is introduced into the hydrogenation reactor 190.

The hydrogenation reactor 190 includes three stacked or superimposed sections. The first section has a top zone 191, a catalytic bed 192, and a bottom zone 193. Similar, the second section also has a top zone 194, a catalytic bed 195, and a bottom zone 196; and the third section has a top zone 197, a catalytic bed 198, and a bottom zone 199.

A hydrogenation catalyst is provided in each of the catalytic beds 192, 195, 198. The hydrogenation catalyst may include any suitable catalysts for hydrogenation treatment and may be obtained from commercial sources or chemical suppliers.

The hydrogen catalyst may be an inert material, including a precious metal such as palladium, gold, nickel, or the like. The catalyst promotes reaction of hydrogen with other molecules, such as with unsaturated hydrocarbons to form saturates, or with sulfur to form $H_2S$.

The stripper/fractionation unit 202 has output lines 204, 206, 208.

During operation, the extract stream is heated by heat exchanger 174 before being introduced into the guard bed 178 through line 172.

Further, a diluent that can increase the solubility of hydrogen in the extract stream is added to the extract stream in line 172 at the diluent inlet 176. The diluent may include a suitable solvent that can dissolve hydrogen. The diluent is continuously added so that the extract stream introduced into the guard bed 178 will have a stable concentration of the diluent. In some embodiments, the diluent may be taken from an output of bottom zone 199 of the third section of the reactor 190.

The diluent and the extract extracted in the solvent extraction column 140 form a liquid mixture, in which hydrogen is more soluble than in the extract stream.

The liquid mixture is introduced into the guard bed 178. The guard bed 178 removes the targeted contaminants present in the extract from the solvent extraction column 140, which contaminants might otherwise poison the hydrogenation catalyst in the hydrogenation reactor 190, and lower the lifetime of the hydrogenation catalyst.

The output from the guard bed 178 is a purified liquid mixture containing the diluent and low quality oil. The purified liquid mixture is transported from the guard bed 178 to a mixer 187 through either transport line 186 or with a mixing insert in an inlet nozzle (not shown) of the reactor 190.

A hydrogen gas is continuously added to the purified liquid mixture through the hydrogen inlet 188. The hydrogen may be added under a constant pressure so the amount of the hydrogen added is stable over time.

Since the liquid mixture contains the diluent, the added hydrogen can be more quickly dissolved in the liquid mixture, and the liquid mixture can contain a higher concentration of hydrogen. As a result, most added hydrogen could be in the liquid phase when the mixture is introduced into the hydrogenation reactor 190.

The mixer 187 outputs a continuous stream of a liquid mixture that includes the purified extract, the diluent, and hydrogen in the liquid phase. The stream of the liquid mixture is introduced into the hydrogenation reactor 190 to undergo a hydrogenation treatment.

As compared to a conventional gas phase trickle bed hydrotreating reactor, in which the hydrogenation reaction rates are limited by the mass transfer of hydrogen from the gas/vapor phase into the liquid phase in the reactor, the embodiment described herein and as illustrated in FIG. 2 can operate at the kinetically limiting mode since the hydrogen is already in the liquid phase when introduced into the reactor 190. Further, the hydrogenation catalyst in the reactor may be completely wetted constantly.

In addition to, or in place of, adding hydrogen at the hydrogen inlet 188, hydrogen may also be added at one or more other points along transport line 186. In some embodiments, additional hydrogen may also be added at various points along the length of hydrogenation reactor 190 through mixing inserts (not shown) provided in the nozzles (not shown) connecting the bottom zone 193 of the first section to the top zone 194 of the second section and the bottom zone 196 of the second section to the top zone 197 of the third section.

However, it has been realized that adding the diluent before adding hydrogen to the liquid mixture and adding hydrogen upstream of the mixer 187 allows more hydrogen to be present in the liquid phase when the mixture is introduced in the reaction zone in the hydrogenation reactor 190, which facilitates more efficient operation. The increased hydrogen solubility also allows the flow rate of the liquid feed to be adjusted over a wider range without significant negative effect on the hydrogenation performance. In particular, the continuous flow liquid phase hydrogenation could allow the entire system or process to proceed on a continuous basis for an extended period, at relatively high yields with high quality base oil products that meet the standard of Group II or even III base oils as defined by API 1509. In some embodiments, the oil products from the MTU 30 may meet the standard of Group III base oil.

The reaction zones in the hydrogenation reactor 190 may be pressurized, such as to a typical pressure of 800 psi to 1200 psi, and heated to a suitable elevated temperature. The hydrogenation catalyst(s) are selected to promote certain reactions over others, so the reactions in the hydrogenation reactor 190 are selective in favor of reactions involving molecules with lower lubrication values or properties, such as unsaturated hydrocarbons or non-saturates.

In the hydrogenation reactor 190, unsaturated hydrocarbons, olefins, elemental contaminants such as sulfur, nitrogen, oxygen, heteroatoms, and the like that are present in the feed stream are hydrogenated. Some of the reaction products are gases, which are vented through the outlets at the top zones 191, 194 and 197 of respective catalyst sections. As a result, the oil product extracted from the hydrogenation reactor through line 200 has an increased level of saturates, a decreased level of contaminants including sulfur, and decreased level of aromatics, and has an increased viscosity index.

The upgraded oil product may be further treated before being provided to customers. For example, the oil product may be transported to the stripper/fractionation unit 202 for further processing.

In the fractionation unit 202, saturated hydrocarbons are fractionated into different fractions, which may include one or more of naphtha, diesel oil, and base oil. The different fractions may be output through different outlets 204, 206, 208.

The output oil product from the MTU 30 may have a higher concentration of saturated hydrocarbons and volatile compounds of hydrogen. The produced oil product thus contains upgraded oil, which may contain at least 90 wt % of saturates and less than 0.03% sulfur, and have a viscosity index of at least 80. The saturate level in the oil product may be higher than 95 wt %. The VI of the oil product may be from 80 to 120, or may be higher than 120.

The oil product may be suitable for use as base oil under Group II or Ill of API 1509.

A portion of the output from the reactor 190 may be recycled back to the reactor 190 through line 201, and inlet 176, as depicted in FIG. 2. The recycled stream could provide at least a portion of the needed hydrogen to the reactor 190, and may also function as a heat sink, thus further reducing temperature fluctuations in the reactor 190. The treatment process in reactor 190 can thus be more isothermal. Flow control devices such as valves, flow meters, or pumps (not shown for simplicity and easier viewing) may be provided in lines 200 and 201 to control and adjust the flow rates in these lines as can be understood by those skilled in the art. A typical recycle rate of the oil product to recycled feed may be 3:1. Recycling in this manner is also beneficial when there is temporary suspension of incoming feed from the MSU 22, as the MTU 30 could continue to run using the recycled feed at a relatively low feed rate with reduced risk of coking and associated plugging in the MTU 30. A pump (not shown) may be used to recycle the recycle stream from reactor 190 to inlet 176.

Also conveniently, the recycled stream is an inert hydrogen carrier.

In some embodiments, make-up hydrogen may be added to the liquid mixture containing the recycled stream, by feeding the make-up hydrogen into the system through the hydrogen inlet 188, for example. A gas compressor (not shown) may be used to compress the hydrogen gas to be added.

As noted above, in the MTU 30, hydrogen is mixed and flashed into the extract stream in the presence of the diluent, which has a relatively high solubility for hydrogen, under a constant pressure. As a result, the hydrogen will be in the liquid phase when the mixture is introduced into the hydrogenation reactor 190.

In some embodiments, excess hydrogen may be added and mixed with liquid mixture of the extract stream and the diluent so that the resulting liquid mixture contains the maximum amount or concentration of hydrogen in the liquid phase, which would increase reaction performance. Some of the added hydrogen may remain in the gas phase when the added hydrogen is in excess of the maximum amount soluble in the given liquid mixture.

The type and amount of the diluent added, and the hydrogenation reaction conditions, can be selected so that sufficient hydrogen is provided in the liquid phase to accelerate the hydrogenation reaction or maximize/optimize the reaction performance.

The diluent may be a solvent, and may include propane, butane, or pentane, or a combination thereof.

The diluent may also be or include light hydrocarbons, light distillates, naphtha, diesel, VGO, hydroprocessed stocks, recycled hydrocracked product, isomerized product, recycled demetaled product, or the like.

Conveniently, as more hydrogen is provided in the liquid phase in an embodiment disclosed herein, the reaction rate can be increased, and the feed flow rate can also be consequently increased to operate at very high flow rates.

Many of the hydrogenation reactions that may occur in the reactor 190 are exothermic, and can thus potentially cause temperature in the reactor to drift or fluctuate depending on the reaction rates and conditions of the catalyst and the availability of hydrogen.

In the embodiment described above, when the fluid flow rate is high, the temperature in the hydrogenation reactor 190 could be more stable, because the temperature is mainly dependent on the temperature of the input liquid mixture, and any temperature fluctuation caused by the heat generated by the hydrogenation reaction is relatively minor. For example, the temperature fluctuation in an embodiment as described herein may be controlled to be within about 5° F. The hydrogenation process may be considered to be generally isothermal.

To further offset any heating effect or to better control the temperature in the system, an air cooler (not shown) may be provided in the MTU 30.

The continuous flow liquid phase hydrogenation reactor is thus more advantageous in system 5 than, for example, a trickle bed reactor conventionally used for upgrading used oils.

It is also expected that with the MTU described herein, less stringent operation control may be possible, as compared to conventional base oil upgrading systems.

It may be desirable in some instances to chemically treat the used oil feed with a base or alkali material such as sodium carbonate, sodium bicarbonate, sodium hydroxide, potassium hydroxide, or the like. Such treatment may be carried out in the heater 44.

Such treatment can condition, stabilize, or otherwise neutralize the used oil to reduce the risk of fouling in the system, to facilitate separation of the used oil stream into constituent parts, or to enhance the quality of any non-base oil by-products.

In some instances, it may also be desirable to add an alkali or base to one or more of the distillation vessels either in the feed stream, recycle stream or directly into the vessel(s).

In the embodiment described above, four distillation vessels are used to separate a base oil fraction from other constituents in the used oil. However, in different embodiments, fewer, such as two or three, distillation vessels, or more, such as eight, distillation vessels, may be used in the CSU to purify the oil feed.

In the embodiment described above, the distillation vessels may be flash vessels. The purification unit may include any device or system that can purify the oil feed, and may include single stage separation/purification devices, such as evaporators, thin or wiped film evaporators, columns, vessels, tanks, pipes, and the like.

In the embodiment described above, steam or a gas may be added to distillation vessels 52, 70, 90 and 112 to help strip tight distillates from the used oil thereby enhancing separation/purification.

Steam stripping is a technique known to those skilled in the art for enhancing distillation processes, and may be utilized in system 5.

In vessel 52, it is not necessary to heat the recycled bottom stream because it is possible to heat the inlet feed stream in heater 44 to a desired temperature without the risk of fouling. The vessel 52 could be operated in the same fashion as vessel 70 by heating and returning a portion of the bottom stream in line 56 to vessel 52 and maintaining a bottom layer in vessel 52.

It may be desirable in some instances to bring the stream recovered through line 96, which has a boiling range typically from about 500° F. to about 650° F. (i.e. gas oil) into combination with the stream in line 172 for hydro-processing since this stream may be suitable for use as base oil. It is not necessary to use this stream to supplement the stream in line 172, but it is an option if desired.

The boiling point range of the material recovered through line 96 can be modified if desired to produce materials having a slightly higher initial boiling point. The stream at line 96 may also be useful as base oil.

For application in the embodiment for stage #2 described above, extraction solvent needs to have a specific gravity greater than the base oil in the feedstock, so that the countercurrents can be formed in the directions as described and illustrated in FIG. 2.

In different embodiments, an extraction solvent having a specific gravity less than the base oil to be extracted, the process and system may be modified to reverse the current flow directions of the solvent and the feedstock. That is, the solvent is introduced into the bottom of the solvent extraction vessel and the feedstock is introduced into the top of the solvent extraction vessel.

Vessels 152 and 154 can still be configured and operated similarly to remove the solvent from the raffinate and extract respectively.

While FIG. 2 shows one guard bed 178, and one hydrogenation reactor 190, in different embodiments, two or more guard beds, configured in series or in parallel, could be used prior to the reactor 190. The guard beds in parallel would be operated one at a time to enable regeneration or clean out and recharging of either of the vessels without interrupting flow to reactor 190.

Similarly, more than one hydrogenation reactors could be operated in series or parallel to enhance operation.

In the embodiment described above it may also be desirable to incorporate a hydrogen recovery system to recover hydrogen from product stream 200. The hydrogen recovery system would purify and recover the hydrogen in this stream and recycle it back for use through the hydrogen inlet 188.

It may also be desirable to employ steam or gas stripping in vessel 202 to remove non-base oil light contaminates from the base oil. An additional vessel could also be added to further process the base oil in line 206 by further fractionating the base oil to form different viscosity cuts, or stripping the base oil to reduce its volatility.

Steam stripping may be utilized to reduce the vapor pressure at a selected location in the system. With reduced vapor pressure, the operation temperature may also be lowered, and thus reducing the heating energy required to maintain operation and the risk of fouling. Steam stripping may also assist to enhance yield and quality of useful oil products.

In the embodiment described above, Stage #2 is used to separate a portion of the higher quality base oil molecules from the lower quality base oil molecules thereby creating a first high quality base oil stream in line 156 wherein the concentration of aromatics, polars, unsaturates, heteroatoms and the like is lower and a second lower quality base oil stream 172 wherein the concentration of aromatics, polars, unsaturates, heteroatoms and the like is higher. It is also possible to further upgrade the high quality base oil stream using processes similar to those in Stage #3 as describe herein, by converting a portion of the aromatic, polar, unsaturated, heteroatom molecules and the like remaining in the high quality base oil stream, to higher quality molecules thereby further purifying it, increasing the degree of saturation and thereby producing an highly purified base oil. This oil may be suitable for use as a white oil in the medicinal or food processing industries as well as a lubricating base oil in the industrial lubrication markets.

In the embodiment shown above, the solvent recovered from the lower and high quality base oils, streams in lines 164 and 166, is combined and purified in the solvent processing and storage unit 148 by removing water and other low boiling point contaminants prior to re-use. The solvent can also be treated at this stage with bases and the like as known to those skilled in the art, to neutralize organic acids that may have built up in the solvent.

In different embodiments, a distillation system may be used to separate base oil fractions from other used oil constituents. The treated used oil stream may be heated to between 250° F. and 450° F., such as between 300° F. and 400° F. in a heater (such as heater 44), and flashed across a valve (not shown) into a flash distillation vessel (such as vessel 52), where a distillate stream (such as in line 54) is recovered from the used oil. The distillate stream may be burned as a process gas or condensed, separated from any water, glycols and the like, and used as a fuel or the like. The bottom outlet stream may be passed or pumped to in-situ flash distillation vessel 70 wherein it passes into a pool of oil resident at the bottom of the vessel. The pool of oil may be kept at a temperature between 400° F. and 600° F., such as between 450° F. and 550° F. by heating it through a recirculation heater (not separately shown) whereby the oil may be pumped out from the bottom of vessel 70, heated in a heat exchanger (such as heat exchanger 84) and passed back into vessel 70. The flow rate of this recirculation stream may be sufficient to provide adequate heat exchange in heater exchanger 84 to keep the liquid layer (pool of oil resident in the bottom of the vessel) at the desired temperature, thereby generating the desired distillate fraction, and maintaining turbulent flow and a high Reynolds number through the tubes of the heater.

The used oil stream entering vessel 70 from vessel 52 may be heated by direct contact with this liquid layer thereby vaporizing constituents of the used oil with a boiling point less than the temperature of the liquid layer and generating a distillate stream (in line 76). This distillate stream may have a boiling range generally from about 350° F. to about 500° F. and may be condensed and used for fuel and the like. A portion of the bottom stream in line 82 may be passed to a third distillation vessel, such as vessel 90.

In some embodiments, the vessel 90 may be a distillation vessel operated similarly as vessel 70 using a hot liquid layer to heat the incoming stream by direct contact. The liquid layer of oil may be kept at a temperature between 550° F. and 750° F., such as between 600° F. and 700° F. by heating it through the recirculation heater 104, whereby the oil is pumped from the bottom of vessel 90, heated in the heater 104, and passed back into vessel 90. A portion of the recirculation stream at line 102 may be passed to the vacuum distillation vessel 112. A liquid layer having a liquid level 110 may be maintained in the lower portion of vessel 90. Vessel 90 may produce a distillate stream 96 having a boiling point ranging from about 500° F. to about 650° F.

In the embodiments described above, vessels 52 and 70 may be operated at atmospheric pressure. These vessels could also be operated at a higher pressure, or under vacuum, as known to those skilled in the art, to effect similar separation of the base oil fraction from the used oil feed. Vessel 90 may be operated under a negative pressure or vacuum, such as from full vacuum to about 500 mmHg, e.g., between 2 mmHg and 30 mmHg.

As illustrated in FIG. 2, vessel 112 is typically a vacuum distillation vessel, which may be operated under vacuum ranging from full vacuum to 500 mmHg, such as between 2 and 30 mmHg. The feed stream at line 106 from vessel 90 may be combined with a recirculation stream at line 126 from the bottom of vessel 112 which has been heated to between 550° F. and 700° F., such as between 600° F. and 650° F. The mass ratio between the two streams may be between 1:2 to 1:40 (feed stream flow rate to the recirculation stream flow rate), such as between 1:10 and 1:20. A distillate stream may be produced and passed through distillate outlet 118. The distillate stream may have a boiling point range from about 650° F. to about 1050° F. A liquid level 130 may be maintained in vessel 112. The bottom stream may be withdrawn through line 120, and passed via pump 122 to the discharge line 124 through which a portion of this stream is recovered as a product. A portion of this stream may also be returned via line 126 and heater 128 to join the stream in inlet line 106. This heated bottom stream may be used to maintain the desired feed temperature to vessel 112.

In an embodiment, it may be advantageous to add a stripping gas such as steam to one or more of vessels 52, 70, 90 and 112 to strip light components from the oil and aid the distillation and separation process. The stripping gas may be added at various points in the bottom half of the vessel or to the oil feed stream to these vessels.

The solvent extraction column 140 may be any suitable agitated continuous flow liquid phase extraction column where the agitation speed is variable and can be controlled without affecting the flow rates. The extraction solvent may be selected from ethanol, diacetone-alcohol, ethylene-glycol-mono(low alkyl)ether, di-ethylene-glycol, diethylene-glycol-mono(low alkyl)ether, o-chlorophenol furfural, acetone, formic acid, 4-butyrotacetone, low alkyl-ester of low mono- and dicarbonic acids, dimethylformamide, 2-pyrrolidone and N-(low alkyl)-2-pyrrolidone, N-methyl-2-pyrrolidone (NMP), epi-chlorohydrin, dioxane, morpholine, low-alkyl and amino(low-alkyl)morpholine, benzonitrile or di-low-alkyl)sulfoxide, and phosphonate, or the like.

In some embodiments, N-methyl-2-pyrrolidone (NMP) may be used as the extraction solvent. The solvent extraction may be undertaken at a temperature at which the extraction solvent and the oil in the feedstock are at least partially miscible, typically between about 100° F. and about 250° F. and preferably between about 130° F. and about 190° F. Typically, both the solvent and oil may be fed into the extraction column within this temperature range although not necessarily at the same temperature. The solvent dosage (percent of solvent relative to the feedstock fed to the extraction column) is typically between 50% and 1000% by volume, such as from 100% to 500%. Typically, solvent extraction is undertaken in a vertical column whereby the solvent is fed into the top of the column and purified used oil is fed into the bottom. Water may be injected into the solvent extraction column as desired to control solvent selectivity.

Similarly, temperature gradients or regional heating or cooling can be used at various points along line 150 or across the solvent extraction column to effect performance and selectivity. Recycles of both raffinate and an extract at similar or different temperatures can also be employed. In some instances it may be beneficial to remove a side stream from the extraction column, cool raffinate or extract streams, cool the side stream, separate a portion of the solvent from the oil and return the oil to the column. The solvent may be recovered from the raffinate stream in line 157 and the extract stream in line 155 using distillation. The distillation can be undertaken atmospherically or by using vacuum. One or more flash separators, vacuum separators, multistage columns and the like, or combinations thereof either operated atmospherically, under pressure or vacuum, can be used in order to separate the solvent from the base oil. A guard bed suitable for use in a system described herein may include activated clay or spent catalyst.

Hydrogenation reactor 190 may be equipped with one or more hydrogenation catalysts with metal components from Groups V(b), VI(b) and VIII of the Periodic Table, as known to those skilled in the art. In some embodiments, compounds of nickel, molybdenum, vanadium, tungsten or cobalt metal supported on carriers such as activated carbon, kieselguhr, silica, alumina and the like such as a cobalt-molybdenum on alumina, nickel-molybdenum on alumina or nickel-tungsten on silica/alumina are used.

Additional processing may be undertaken on the distillate stream in line 54 from vessel 52 such as further separating the constituents of this stream such as water, glycols, solvents, light hydrocarbons and the like, thereby creating separate products which may be used or further upgraded to higher quality products. These product streams may also be further treated to improve their quality as known to those skilled in the art.

In some embodiments, only one distillate cut is taken from vessel 112 for further processing in stage #2. It is also possible to take a second cut or add another fractionation vessel (not shown) after vessel 112 to further fractionate the base oil distillate to produce different viscosity grades and the like of base oil, which can then be processed separately in stage #2 and stage #3.

In some instance, a phase transfer catalyst or the like may be used to enhance the operation at Stage #2, so the efficiency and selectivity of the process are enhanced, thereby providing for better separation of the high quality base oil molecules from the lower quality base oil molecules.

In the third stage of the process presented in the embodiment it may be advantageous to have multiple guard beds, run reactors in parallel or series to utilized phase separators or the like between reactors or between guard beds and reactors. Furthermore, in some instances it may be advantageous to strip the base oil of light contaminants or further fractionate it into different viscosity cuts. Although the system described herein does not utilize a hydrogen recovery system one could be employed to recovery and purify un-reacted hydrogen and reaction products after separation from the product base oil.

As described above, in embodiments of the present disclosure, a base oil fraction is separated from the used oil feed and thereafter separated into a high quality base oil stream and a lower quality base oil stream with the lower quality base oil stream then being upgraded to produce base oil product with improved quality. The combination of these steps can provide an improved process, and address one or more of the problems discussed previously.

The incorporation of a continuous flow liquid phase hydroprocessing in the last stage provides a constant surplus of hydrogen during hydrogenation reactions, which can conveniently prevent or reduce catalyst coking. In addition, incorporation of the continuous flow liquid phase hydrogenation process eliminates the need to use trickle beds in the final upgrading step, thereby avoiding the problem of fouling of conventional reactors in re-refineries.

Continuous flow liquid phase hydroprocessing also conveniently allows better control of the heat inside the reactor and helps in maintaining a steady temperature inside the reactor, thereby minimizing the need for multiple catalyst beds and large amount of hydrogen gas to quench the reactor.

It is noted that used oils can contain sludge and long-chain polymers, which may be formed due to usage and degradation of the engine oil or motor oil during use, or during the re-refining process. The presence of these sludge and long chain polymers could cause fouling and affect the run length of treatment processes at various stages. In an embodiment as disclosed herein, these materials may be effectively managed and removed, thus reducing the risk of fouling and prolong the run length of the treatment processes. For example, fouling in the CSU may be reduced by reducing internal surfaces in the distillation vessels, reducing rotating equipment, increasing flow rate, or reducing operation temperatures, or combinations thereof. Recirculation of residuals also helps to maintain higher flow rates. Using staged distillation in flash and vacuum distillation vessels, instead of thin-film evaporators (TFE), could allow sequential removal of physical contaminants with more efficient separation and increased yields of quality VGO, and reduced fouling. Thus, a wider range of UMO feedstocks may be suitable for processing in an embodiment disclosed herein, as compared to a conventional re-refining system. An embodiment of the CSU as disclosed herein may have a long on-stream run time, such as more than 6 months.

In some embodiments, the MSU may be used to separate long chain lube oil molecules from short or circular chain lobe oil molecules. The long chain lube oil molecule may be further purified to provide an oil product, and the short or circular chain lobe oil molecules are further processed in the MTU to form an oil product.

An embodiment of the MTU described herein may be operated for continuous flow, but may also be operated in the batch mode if desired.

Metals, phosphorus, silicon, and long chain polymers present in the feedstock may remain in the raffinate stream from the MSU, which if allowed into the hydrogenation reactor could deactivate the catalyst and cause fouling, particularly at lower flow rates in a gas phase trickle bed hydrogenation reactor. In embodiments described herein, such downsides and problems may be reduced or avoided, as discussed above.

Further, treated oil may be recycled back to the inlet of the hydrogenation reactor 190, which allows efficient use of hydrogen to keep excess hydrogen in the reaction zone in the reactor. The recycled stream may also act as a heat sink to maintain more uniform and stable temperature in the reactor, thus allowing better temperature control, and reduces the risk of coking in the reactor. The hydrogenation reactor as described herein may be readily configured and adapted to accommodate changes in the feedstock or input used oils.

It may also be noted that since some of the oil products are already extracted and output from the MSU, which may be up to two third of the feedstock, the fluid volume to be processed in the MTU is only a portion of the feedstock, such as less than one third.

In an embodiment, a method includes a) obtaining a feedstock comprising a distillate; b) subjecting the feedstock to solvent extraction to obtain a high quality base oil fraction and a low quality base oil fraction; and c) subjecting the low quality base oil fraction to a continuous flow liquid phase hydroprocessing process to convert said low quality base oil into a high quality base oil fraction, ultra-low sulfur diesel, and naphtha. In this embodiment, the distillate may have a boiling point between about 500° F. to about 1200° F. Prior to step b), the partially purified oil fraction may be subjected to oxidation, ozonation, acid treatment, or magnetic filtration. The distillate may be obtained by distillation of a used oil stream. The distillation may include i) distilling the waste oil stream to separate at least a portion of material having a boiling point less than about 350° F. from the waste oil to produce a de-volatized oil fraction and a light oil fraction; ii) separating at least a portion of material with a boiling point greater than about 350° F. and less than about 650° F. from the de-volatized oil fraction to produce a fuel oil fraction and a heavy oil fraction; iii) separating at least a portion of material with a boiling point from about 650° F. to less than 1200° F. from the heavy oil fraction to produce a partially purified oil fraction and a residual fraction. The used oil stream may be subject to oxidation, ozonation, acid treatment, or magnetic filtration, prior to distillation. In some embodiments, the distillates may also include distillates obtained from an upgrading process of crude oil. The step c) may include i) adding a solvent/diluent to a stream of the low quality base oil fraction to form a continuous flow liquid phase diluent and feed mixture; ii) adding hydrogen to said diluent and feed mixture in a constant pressure environment, to form a continuous liquid phase feed, diluent and hydrogen mixture; and iii) reacting the continuous liquid phase feed, diluent and hydrogen mixture in the presence of a catalyst to remove predetermined compounds from the feed mixture, and thereby converting said low quality base oil into a high quality base oil fraction, ultra-low sulfur diesel, and naphtha.

In some embodiments, a continuous flow liquid phase hydroprocessing step may be conducted in a reactor at a predetermined temperature, and having an upper zone of gases and a substantially larger lower zone of hydrogen dissolved in a mixture of liquids surrounding the catalyst.

The light oil fraction may be separated from the de-volatized oil fraction by at least one of atmospheric or vacuum distillation. The fuel oil fraction may be separated from the heavy oil fraction by at least one of atmospheric or vacuum distillation. The partially purified fraction may be separated from the residual oil fraction by vacuum distillation in an unpacked column.

In some embodiments, a solvent extraction step may include use of one or more solvents selected from ethanol, diacetone-alcohol, ethylene-glycolmono(low alkyl) ether, di-ethylene-glycol, diethylene-glycolmono(low alkyl) ether, ochlorophenol furfural, acetone, formic acid, 4-butyrolacetone, water, aqueous salts, lowalkyl-ester of low mono- and dicarbonic acids, dimethylformamide, 2-pyrrolidone and N(low alkyl)2-pyrrolidone, N-methyl-2-pyrrolidone (NMP), mono or poly protic acids, mineral acids, carboxylic acids, hydroxide bases, carbonate bases, mineral bases, epichlorohydrin, dioxane, morpholine, low-alkyl- and amino(low-alkyl)morpholine, benzonitrile and di-(low-alkyl)sulfoxide and phosphonate.

The extraction solvent may be N-methyl-2-pyrrolidone, optionally in combination with one or more additional solvents. A solvent extraction step may be carried out in an extraction column designed to limit entrainment and enable good separation of the oil and extractant phases.

It is noted that the saturate and sulfur levels and VI of base oils indicated herein are measured using the tests and analytical methods specified in API 1509, Table E-1. Specifically, the saturate level is measured according to ASTM International standard, ASTM D2007, the VI is measured according to ASTM D2270, and the sulfur level is measured according to one or more of ASTM D1552, D2622, D3120, D4294, or D4927.

As used herein, the term "about" when used with a numerical value indicates that a 10% variation, either above or below the given value, is permissible, unless otherwise specifically indicated.

It will be understood that any range of values herein is intended to specifically include any intermediate value or sub-range within the given range, and all such intermediate values and sub-ranges are individually and specifically disclosed.

It will also be understood that the word "a" or "an" is intended to mean "one or more" or "at least one", and any singular form is intended to include plurals herein.

It will be further understood that the term "comprise", including any variation thereof, is intended to be open-ended and means "include, but not limited to," unless otherwise specifically indicated to the contrary.

When a list of items is given herein with an "or" before the last item, any one of the listed items or any suitable combination of two or more of the listed items may be selected and used.

Of course, the above described embodiments of the present disclosure are intended to be illustrative only and in no way limiting. The described embodiments are susceptible to many modifications of form, arrangement of parts, details and order of operation. The invention, rather, is intended to encompass all such modification within its scope, as defined by the claims.

What is claimed is:

1. A method comprising:

contacting a feedstock comprising purified used oil with an extraction solvent to perform continuous liquid-liquid solvent extraction, to produce an extract stream comprising the extraction solvent and an extract dissolved in the extraction solvent, wherein the feedstock and the extraction solvent form countercurrents in a solvent extraction column and are agitated by a variable speed agitator during the solvent extraction at a selected agitation speed, the agitation speed and the flow rates of the feedstock and extraction solvent into the solvent extraction column being adjusted independently based on a quality or property of the feedstock;

separating the extract from the extraction solvent; and subjecting the extract to a continuous flow liquid phase hydrogenation treatment to produce an oil product having a viscosity index of at least 80.

2. The method of claim 1, wherein the liquid phase hydrogenation treatment comprises:

adding a diluent to the extract to increase solubility of hydrogen in the extract, thus forming a liquid mixture comprising the diluent and the extract;

adding hydrogen to the liquid mixture to dissolve the hydrogen in the liquid mixture; and heating the liquid mixture with dissolved hydrogen in the presence of a hydrogenation catalyst to saturate unsaturates in the liquid mixture, and removing sulfur and aromatics from the liquid mixture, thus forming the oil product.

3. The method of claim 2, wherein the extract comprises phosphorus, and silicon, and the continuous flow liquid phase hydrogenation treatment comprises removing phosphorus and silicon from the liquid mixture before exposing the liquid mixture to the hydrogenation catalyst.

4. The method of claim 1, wherein the extract comprises aromatics, and the continuous flow liquid phase hydrogenation treatment comprises removing aromatics from the oil product.

5. The method of claim 1, wherein the extraction solvent comprises n-methyl-2-pyrrolidone.

6. The method of claim 1, wherein the oil product comprises at least 90 wt % saturates.

7. The method of claim 6, wherein the oil product comprises at least 95 wt % of saturates.

8. The method of claim 1, wherein the oil product comprises less than 0.03 wt % of sulfur.

9. The method of claim 1, wherein the oil product has a viscosity index of at least 120.

10. The method of claim 1, wherein the purified used oil comprises purified used motor oil.

11. The method of claim 1, wherein the purified used oil comprises purified used industrial oil.

12. The method of claim 1, comprising purifying used oil to produce the feedstock.

13. The method of claim 12, wherein the purifying comprises subjecting the used oil to distillation to form the feedstock comprising a distillate from the distillation.

14. A system comprising:

a purification unit configured to purify used oil, to form a feedstock comprising purified used oil;

a continuous counter-current liquid-liquid extraction column for extracting an extract from the feedstock using an extraction agent, the extraction column comprising an agitator configured to agitate the feedstock and the extraction solvent flowing through the extraction column at a variable agitation speed; and a continuous flow liquid phase hydrogenation unit for hydroprocessing the extract extracted by the extraction column to produce an oil product, wherein the continuous flow liquid phase hydrogenation unit comprises:

a hydrogenation reactor comprising a hydrogenation catalyst;

a transport line in fluid communication with the solvent extraction column and the hydrogenation reactor, for transporting the extract from the solvent extraction column to the hydrogenation reactor;

a diluent inlet on the transport line, for introducing a diluent into the extract flowing through the transport line to form a liquid mixture comprising the extract and the diluent;

a hydrogen inlet on the transport line located downstream of the diluent inlet, for introducing hydrogen into the liquid mixture; and a guard bed located on the transport line between the diluent inlet and the hydrogen inlet, the guard bed configured to remove at least phosphorus and silicon from the liquid mixture.

15. The system of claim 14, wherein the hydrogenation catalyst comprises a metal.

16. The system of claim 14, wherein the purification unit comprises one or more distillation columns.

17. The system of claim 15, wherein the metal is palladium, gold, or nickel.

18. A method comprising:

contacting a feedstock comprising purified used oil with an extraction solvent to perform continuous liquid-liquid solvent extraction, to produce an extract stream comprising the extraction solvent and an extract dissolved in the extraction solvent, wherein the feedstock and the extraction solvent are agitated by a variable speed agitator during the solvent extraction at a selected agitation speed;

separating the extract from the extraction solvent; and subjecting the extract to a continuous flow liquid phase hydrogenation treatment to produce an oil product having a viscosity index of at least 80, wherein the liquid phase hydrogenation treatment comprises:

adding a diluent to the extract to increase solubility of hydrogen in the extract, thus forming a liquid mixture comprising the diluent and the extract;

adding hydrogen to the liquid mixture to dissolve the hydrogen in the liquid mixture; and heating the liquid mixture with dissolved hydrogen in the presence of a hydrogenation catalyst to saturate unsaturates in the liquid mixture, and removing sulfur and aromatics from the liquid mixture, thus forming the oil product, wherein the extract comprises phosphorus, and silicon, and the continuous flow liquid phase hydrogenation treatment comprises removing phosphorus and silicon from the liquid mixture before exposing the liquid mixture to the hydrogenation catalyst.

* * * * *